US006986178B2

(12) United States Patent
Turner

(10) Patent No.: US 6,986,178 B2
(45) Date of Patent: Jan. 17, 2006

(54) PORTABLE BIVOUAC SHELTER

(76) Inventor: Timothy D. Turner, P.O. Box 126, Stevensville, MT (US) 59870

( * ) Notice: Subject to any disclaimer, the term of this patent is extended or adjusted under 35 U.S.C. 154(b) by 50 days.

(21) Appl. No.: 10/216,697

(22) Filed: Aug. 12, 2002

(65) Prior Publication Data

US 2004/0025929 A1 Feb. 12, 2004

(51) Int. Cl.
*A47G 9/08* (2006.01)

(52) U.S. Cl. ..... 5/413 R; 5/656

(58) Field of Classification Search ..... 5/413 R, 5/413 AM, 417, 420, 656, 484
See application file for complete search history.

(56) References Cited

U.S. PATENT DOCUMENTS

| | | | | | |
|---|---|---|---|---|---|
| 1,246,544 | A | * | 11/1917 | Chassaing | 5/187 |
| 2,036,033 | A | | 7/1936 | Fisher | |
| 2,537,537 | A | * | 1/1951 | Ljungberg | 5/413 R |
| 2,830,305 | A | * | 4/1958 | Freepons | 5/413 R |
| 2,899,693 | A | * | 8/1959 | Stollenwerk | 5/627 |
| 3,341,869 | A | * | 9/1967 | Whitman | 5/413 R |
| 3,751,741 | A | * | 8/1973 | Hendry | 5/413 AM |
| 3,787,906 | A | * | 1/1974 | Hunt | 5/413 R |
| 3,831,206 | A | * | 8/1974 | Geary | 5/413 R |
| 3,857,125 | A | * | 12/1974 | Hunt | 5/413 R |
| 3,959,834 | A | * | 6/1976 | Hunt | 5/413 R |
| 4,232,692 | A | | 11/1980 | Atkins | |
| 4,590,956 | A | | 5/1986 | Griesenbeck | |
| 4,601,076 | A | * | 7/1986 | Knobeloch | 5/413 R |
| 4,605,029 | A | * | 8/1986 | Russell | 135/125 |
| 4,790,040 | A | * | 12/1988 | Grilliot et al. | 5/413 R |
| 4,884,303 | A | * | 12/1989 | Scherer | 5/413 R |
| 5,005,236 | A | * | 4/1991 | Hutchinson | 5/413 AM |
| 5,217,034 | A | | 6/1993 | Yih et al. | |
| 5,396,669 | A | * | 3/1995 | Nieminen | 5/83.1 |
| 5,406,658 | A | * | 4/1995 | Olkkonen et al. | 5/83.1 |
| 5,690,134 | A | | 11/1997 | McCauley | |
| 5,699,820 | A | | 12/1997 | Evans et al. | |
| 5,735,003 | A | * | 4/1998 | Judge | 5/413 AM |
| 5,881,405 | A | | 3/1999 | Garrigues | |
| 5,941,264 | A | | 8/1999 | Gregg | |
| 5,966,756 | A | * | 10/1999 | Cartier | 5/413 R |
| 6,018,830 | A | * | 2/2000 | Howe | 5/413 R |
| 6,449,787 | B1 | * | 9/2002 | Thorne | 5/413 R |
| 6,463,604 | B1 | * | 10/2002 | Reveron et al. | 5/413 R |
| 2004/0025929 | A1 | * | 2/2004 | Turner | 135/133 |

* cited by examiner

*Primary Examiner*—Robert G. Santos
(74) *Attorney, Agent, or Firm*—Eric N. Mahler

(57) ABSTRACT

A shelter is formed by joining a resilient sleeping pad at its edges to a thin, flexible, waterproof, vapor-breathable shell. The sleeping pad, being the floor of the shelter, eliminates material otherwise used for this purpose. An opening in the shell for the user's face, is edged with a sleeve containing a drawstring for closing the opening to the extent desired. A zippered separation in the shell extends from the opening, to provide easy access into the shelter. A canopy, attached to the shelter, is supported above a user by long, resilient wands attached to the canopy material. Various embodiments are disclosed for combining a canopy with the basic shelter, for supporting the canopy above the user, and for providing entry into the resulting shelter.

10 Claims, 3 Drawing Sheets

12
10
28
20
2
2
25
26
27
11

10
19
17
16
11
15
13
14

34d
32c
30
43
44
12
10
11
31a 10
23
22a
24
14a
14
21
14b
13
11
22b 10
18
13
19
14
11

41
6
42
40
30
43
33b
33d
33c
29
39
26
10
12
11
7
38
7
32
37
33a
31a
6
34c
31b
37a
29a
33b
40
41

34a
29
33b
30
39
31a
12
31b
26
27
10
28
25
37
38
32
33a 32
29
34b
8
8
32

PORTABLE BIVOUAC SHELTER

CROSS-REFERENCES TO RELATED APPLICATIONS

Not applicable.

FEDERALLY SPONSORED RESEARCH OR DEVELOPMENT

Not applicable

REFERENCE TO MICROFICHE APPENDIX

Not applicable

BACKGROUND OF THE INVENTION

1. Field of the Invention

This invention relates to personal, portable, bivouac shelters. More specifically, it relates to such shelters in combination with sleeping pads, wherein the sleeping pad, itself, forms a part of the shelter or enclosure—in which a sleeping bag and other items may be enclosed along with the occupant.

2. Description of the Related Art

A portable shelter is usually the bulkiest and heaviest part of a backpacker's gear for extended hiking trips. It is also the most difficult to handle in inclement weather. Traditionally, the portable shelter has comprised a light-weight tent for protection against the elements and insects, a sleeping bag, and a foam or inflatable sleeping pad that served the dual purpose of providing a soft surface on the usually-hard ground and thermal insulation between the user and the ground. More recently, the tent has been replaced by a bivouac bag, which is essentially a waterproof, but air-and-vapor breathable, tubular outer shell that is closed at one end, but open at the other, so that a sleeping pad and sleeping bag can be inserted therein. The open end is zippered or equipped with a drawstring to provide a completely-enclosed shelter—or one that can be closed around the user's face. In this system, three large, bulky shelter components—the bivouac bag, sleeping pad, and sleeping bag—must be arranged to form a complete shelter. While this is a small problem under ordinary circumstances or for short hikes, it can be quite inconvenient in inclement weather or for extended hikes. Other problems with the conventional bivouac bag is that it does not enable its occupant to sit upright without being exposed to the elements, and it does not provide protected storage space for toiletry items, etc.

SUMMARY OF THE INVENTION

An object of the present invention, therefore, is to provide a portable, bivouac shelter system that solves problems in state-of-the-art camping gear and reduces the weight and bulk thereof by combining the upper portion of a bivouac bag with a sleeping pad. The pad is integral therewith and forms the bottom of the shelter—thus eliminating a major portion of the material of the bivouac bag—which is typically heavy and expensive.

Another object of the invention is to provide a portable bivouac shelter that can be simply unrolled and occupied almost immediately, by saving the time otherwise needed to arrange a sleeping pad inside the bivouac bag—since the sleeping pad is no longer an extra item.

Another object of the invention is to provide a shelter that includes a canopy, attached to the bivouac bag, that can provide protected storage space for toiletry items, etc., and can enable the user to sit upright, while protected from the elements—without the weight and bulk of a tent.

Another object of the invention is to provide a shelter in which the canopy is supported by segmented wands, wherein the wands (except for one) are all of the same length and the segments of each wand are foldably fastened together by internal elastic strands. Hence, the wands can be easily installed in the canopy without the user's having to make wand-length choices or locate parts.

Another object of the invention is to provide a shelter wherein the canopy can easily be completely closed, partially opened, or completely opened.

Another object of the invention is to provide a shelter wherein shallow punctures in the floor of a preferred embodiment of the shelter will not destroy its effectiveness as a watertight shelter.

Other features and advantages of the invention will be noted as the following, detailed description is read with reference to the drawings, wherein the same parts are designated by the same characters throughout the disclosure.

DESCRIPTION OF THE PREFERRED EMBODIMENTS

As shown in FIGS. 1–4, a thin, flexible, outer shell 10 and a sleeping pad 11 are combined to form a tubular structure or bivouac bag 12, closed at one end and closeable at the other end. This combination eliminates about a third of the bulk and weight of the material that would otherwise comprise a conventional bivouac bag and sleeping pad. In a preferred embodiment of the invention, the shell 10 is water-proof, but vapor-breathable material. Such materials are presently on the market. The sleeping-pad portion of the tubular structure can be any of a number of yielding, or resilient, water-proof pads, such as pads of closed-cell foam materials (e.g., a polyolefin foam), open-cell plastic foam enclosed in a water-proof membrane, an inflatable pad, or any similar device. In a preferred embodiment of the invention, the pad 11 is made of closed-cell, plastic foam. In the present description, the term "sleeping pad" refers to a flat, yielding or resilient pad that provides a softened surface and thermal insulation between the user and the ground. The pad 11 can be in any of the popular configurations for such pads, such as the "mummy" shape, wherein the head and foot portions of the pad are narrower than the shoulder portion, or it may be the short version of a rectangular pad, in which the pad 11 extends approximately to the user's knees. In this latter form, the outer shell 10 forms the closed, tubular structure 12 below the user's knees. However, in a preferred embodiment of the invention, the sleeping pad 11 is full-length and rectangular, wherein the pad extends well beyond both the feet and head of the user, and it is amply wide to support the shoulders of a typical user.

Figure 2:
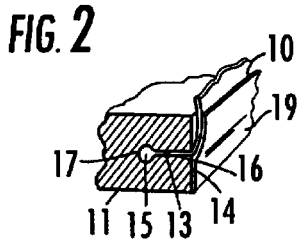
FIG. 2 is a sectional view taken on Line 2—2 of FIG. 1, to show a preferred means of attaching the bivouac-bag material to the sleeping pad.
Figure 4:
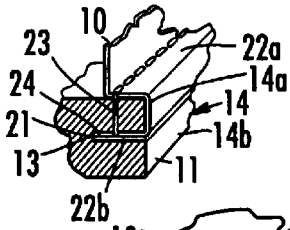
FIG. 4 is a fragmentary section, similar to FIG. 2, to show an alternate means of fastening the bivouac-bag material to a foam sleeping pad.
Figure 3:
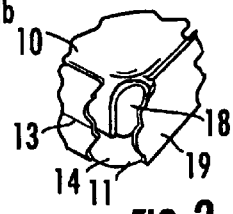
FIG. 3 is corner view of the embodiment of FIG. 2, showing how the corners of the bivouac-bag material are arranged with respect to the sleeping pad.

The lower edges 13 of the outer shell 10 can be fastened to the outer edges 14 of the sleeping pad 11 by any of several means, such as welding, gluing, or stitching, to form the tubular structure 12. FIGS. 2–4 show two such means. In a preferred means (FIGS. 2 and 3), the edges of the shell 10 are beads 15 that are forced into slots 16 in the outer edges 14 of the pad 11—the beads 15 fitting into tubular inner portions 17 of the slots. FIG. 3 shows how the edges of the shell 10 are separated at the corners of the pad, forming a gap 18 in the edge portions of the shell at each corner of the pad 11. A strip of adhesive tape 19 is applied to the entire edge of the pad 11 to cover the gaps 18 and insure integrity of the edges of the pad.

FIG. 4 shows an alternative means of fastening the edges 13 of the shell 10 to the pad 11—this is especially useful when the edge portions of the pad are quite flexible. A longitudinal slit 21 is made in the edges 14 of the pad 11, dividing them into an upper edge portion 14*a* and a lower edge portion 14*b*. The edges 13 of the shell are then folded around the edges 14*a* of the pad 11, so that the extreme edges 13 are inserted into the slit 21, forming horizontal layers 22*a* and 22*b* thereon. The layers 22*a* and 22*b* are then stitched to the edge portions 14 of the pad 11 by threads 23, and a layer of double-stick, adhesive tape 24 is inserted between the lower layer 22*b* of the shell edge 13 and the lower edge portion 14*b* of the pad 11.

Figure 1:
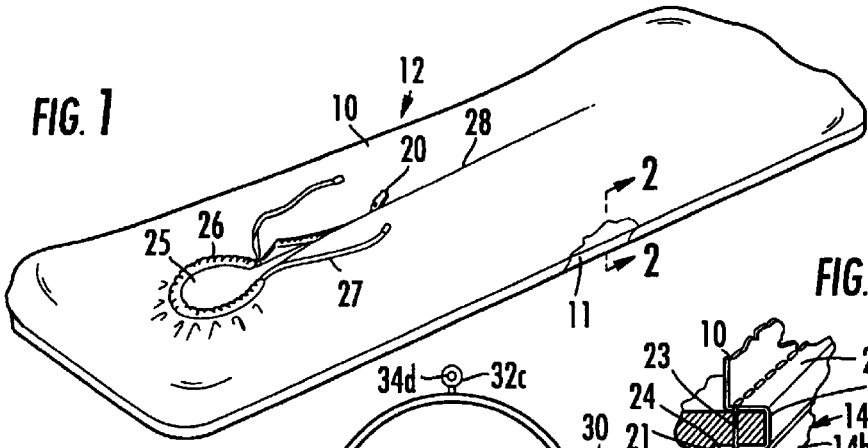
FIG. 1 is a perspective view of a preferred embodiment of the invention.
Figure 7:
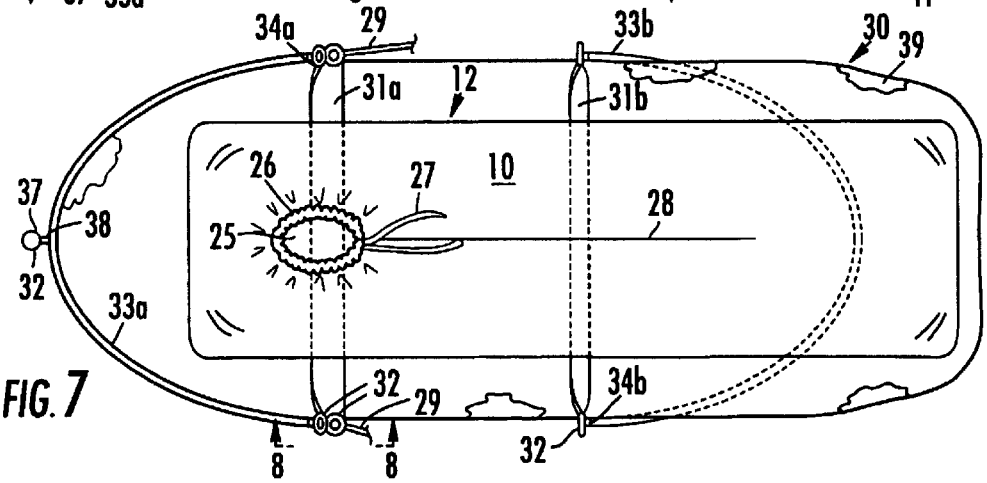
FIG. 7 is a sectional view taken on Line 7—7 of FIG. 5.
Figure 9:
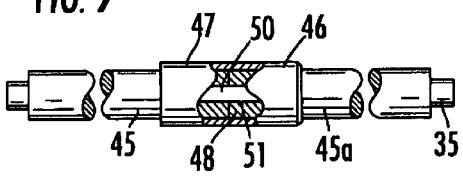
FIG. 9 is an enlarged view showing the typical construction of a wand.

An opening 25 near one end of the tubular structure or improved, bivouac bag 12 is positioned to coincide approximately with the user's face. This opening is bounded by a sleeve 26 containing a drawstring 27, whereby the opening 25 can be adjusted from a small aperture just large enough for breathing to an opening that surrounds the user's face without constriction (FIGS. 1 and 7). The user can use this opening 25 for controlling body-heat loss, as well as for freedom of head movement. When the opening 25 has been adjusted as desired, the ends of the drawstring 27 can be tied to maintain the size of the opening 25. A first separation 28 in the top of the outer shell 10 extends from the opening 25 to about the position of the user's knees to promote ease of entry into the bivouac bag 12. This separation is equipped with a zipper 20, whereby it can be closed or opened to the extent desired. The shelter is normally used by arranging it flat on the ground with the opening 25 on top, untying the drawstring 27, unzipping the separation 28, placing a sleeping bag into the bivouac bag 12 and climbing in.

Figure 8:
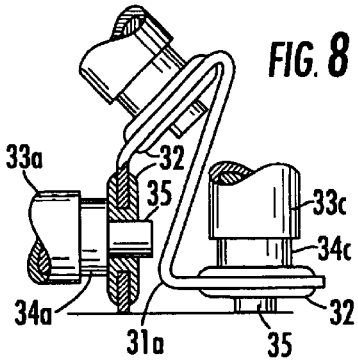
FIG. 8 is a greatly-enlarged view taken on Line 8—8 of FIG. 7, shown partially in section.
Figure 10:
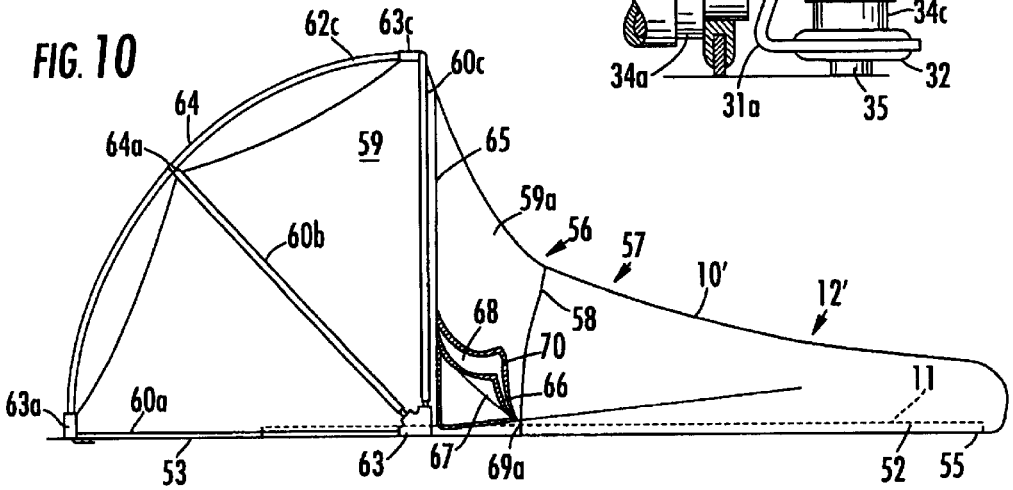
FIG. 10 is a side view of a third embodiment of the invention.

In a second embodiment of the invention (FIGS. 5–9) a rain shelter or canopy 30 is attached to the pad 11 via a first strap 31*a* and a second strap 31*b* that extend beneath the pad 11 and are attached to it transversely to its major axis at approximately the positions of the user's shoulders and hips, respectively. The first strap 31*a* holds two grommets 32 in each of its end portions, and the second strap 31*b* holds one grommet 32 in each of its end portions (FIGS. 7 and 8). The canopy 30 can be of any light-weight, water-proof material. Whereas the upper shell 10 of the bivouac bag is preferably air-and-vapor breathable to avoid water condensation in contact with an enclosed sleeping bag, this is not necessary for the canopy 30, which normally permits adequate ventilation around the bivouac bag 12 to prevent such condensation. As conventionally used, "air-and-vapor-breathable but waterproof" refers to any of the materials on the market that are impervious to water, but admit passage therethrough of airborne vapor droplets and air molecules. The size of the canopy 30 is such that the user can sit upright in it and can store various items in the spaces between the head-end portion of the pad 11 and the inside of the canopy 30.

Figure 6:
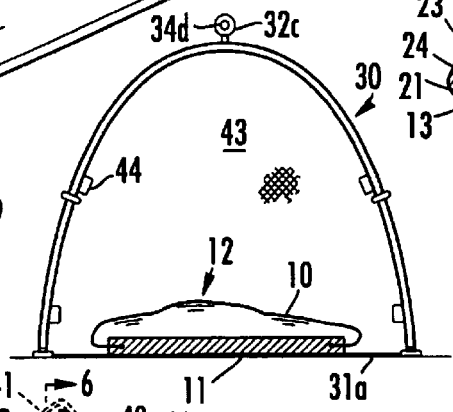
FIG. 6 is a sectional view taken on Line 6—6 of FIG. 5.

As viewed from the top (FIG. 7, the canopy 30 is oval in configuration, and is essentially bounded by two long sleeves. The head-end sleeve 33*a* (normally behind the user's head when the canopy is deployed) forms the head-end edge of the canopy and the foot-end sleeve 33*b* forms the foot-end edge of the canopy 30. Two long, resilient wands (FIG. 8, the head-end wand 34*a* and the foot-end wand 34*b* fit into their respective sleeves 33*a* and 33*b*. The wands are longer than their sleeves, so that the end portions 35 of each wand extend beyond their sleeves. This end portion 35 of each wand is smaller in diameter than the wand, so that it can be fitted into one of the grommets 32, whereas the remainder of the wand is too large to enter a grommet 32. Similarly, an upright sleeve 33*c* is fastened to the canopy 30 (either inside or outside the canopy, but preferably inside) between sleeves 33*a* and 33*b*, so that, when the upright wand 34*c* is installed therein, it is supported in an approximately vertical position by the canopy material. Like the wands 34*a* and 34*b*, the end portions 35 of the upright wand 34*c* are inserted into grommets 32 in the end portions of the strap 31*a* on opposite sides of the canopy 30 (FIG. 6). The distance between grommets of each wand is shorter than the wand, causing each wand to form an arch. Hence, the upright wand 34*c* determines the height of the canopy. To promote ease of setting up the shelter and to avoid having to compare sizes of wands under possibly-adverse conditions, all of the sleeves 33*a*–33*c* and wands 34*a*–34*c* are of the same length. An intermediate sleeve 33*d* between the sleeves 33*a* and 33*c* holds an intermediate wand 34*d* that is anchored in grommets 32, similarly to wands 34*a*, 34*b* and 34*c*.

Figure 5:
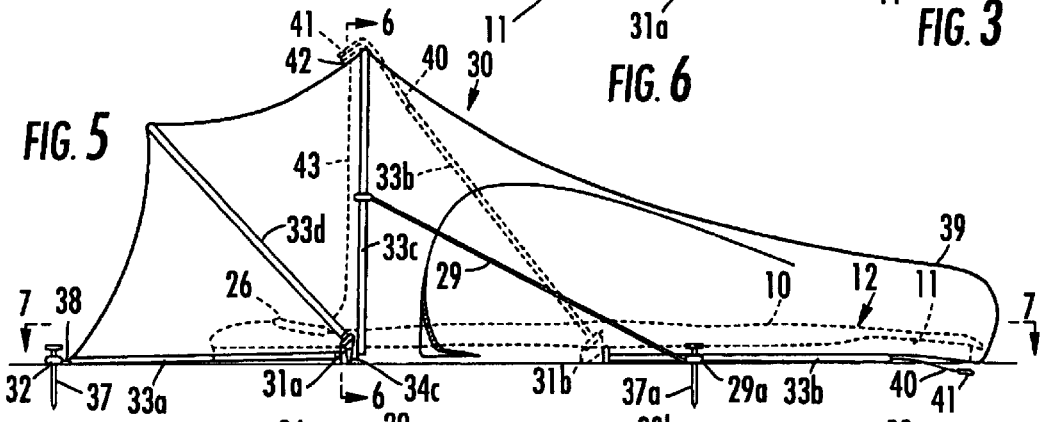
FIG. 5 is an elevation view of a second embodiment of the invention that includes a canopy—an alternate position of the foot-end wand being shown in broken lines.

As shown in FIGS. 5 and 7, the canopy 30 is longer than the bivouac bag, and, when deployed, the head-end and foot-end wands 34*a* and 34*b* are both in horizontal positions on the ground. Hence, the head end of the canopy may be anchored to the ground by a tent peg 37 driven through a grommet 32 held by a small tab 38 attached to the head-end sleeve 33*a*. The tab 38 is flexible, so that the peg 37 can be used either inside or outside the canopy 30. The foot end of the canopy 30 is anchored against possible wind by the user's feet-the canopy material being extended to form a large pouch 39 that extends beyond the foot-end sleeve 33*b*, and fits over the foot end of the bivouac bag, so that the foot-end wand 34*b* is held beneath the user's feet when the shelter is being occupied.

The user may open the canopy 30 by moving the foot-end wand 34*b* into a substantially-vertical position adjacent the upright wand 34*c* (shown in broken lines in FIG. 5), draping the canopy material between those wands over the portion of the canopy between the upright wand 34*c* and the intermediate wand 34*d*. The foot-end wand 34*b* can be temporarily fastened in this position by a small strap 40, attached at one end to the apex of the footend sleeve 33*b* and having a hook-and-loop (e.g. Velcro) fastener pad 41 on its other end that can engage a matching pad 42 on the canopy material adjacent the upright sleeve 33*c*. In this arrangement, however, the wands 34*b*, 34*c*, and 34*d* have a tendency to collapse on top of the head-end wand 34*a*. This is prevented by at least one thin line 29 attached at one end to the upper portion of the upright sleeve 33*c* and anchored at the other end either to the foot-end portion of the bivouac bag by some means, such as hook-and-loop pads, or a hook and grommet. FIG. 5 shows the free end of the line 29 anchored to the ground via a loop 29*a* fastened to the line 29 through which a tent peg 37*a* is driven into the ground. The preferred arrangement is to have two lines 29, one on each side of the canopy 30.

Alternatively, the head-end portion of the canopy 30 can be opened by removing the tent peg 37 and rotating the head wand, intermediate wand, and upright wand toward the foot end of the shelter until they all rest on the canopy 30 below the user's hips.

As shown in FIGS. 5 and 6, a panel of insect-proof netting 43 is attached to the inside of the canopy adjacent the upright sleeve 33*c*. It falls loosely over the bivouac bag and is attached at its sides by hook-and-loop fasteners 44 to the sides of the canopy 30.

Each of the wands is of conventional construction wherein it is made of several segments 45 (FIG. 9), one end of each segment being fitted with a metal ferrule 46 that extends beyond the end of the wand segment to form a female receptacle 47 to receive the bare end 48 of the adjacent wand segment. Since the ferrules 46 are only necessary between segments, one end segment 45*a* of each wand is not fitted with a ferrule 46. Further, the wand segments are fastened together with a long, elastic strand 50 that extends through a central channel 51 through the entire wand and is attached to the end segments thereof. This, also, is conventional construction, used to promote ease of assembling each wand. Although the embodiment of the invention described uses the long sleeves to attach the wands to the canopy, each of these sleeves could be replaced by a series of loops attached to the canopy, short sleeves, rings, spring clips, hooks, etc.

Figure 11:
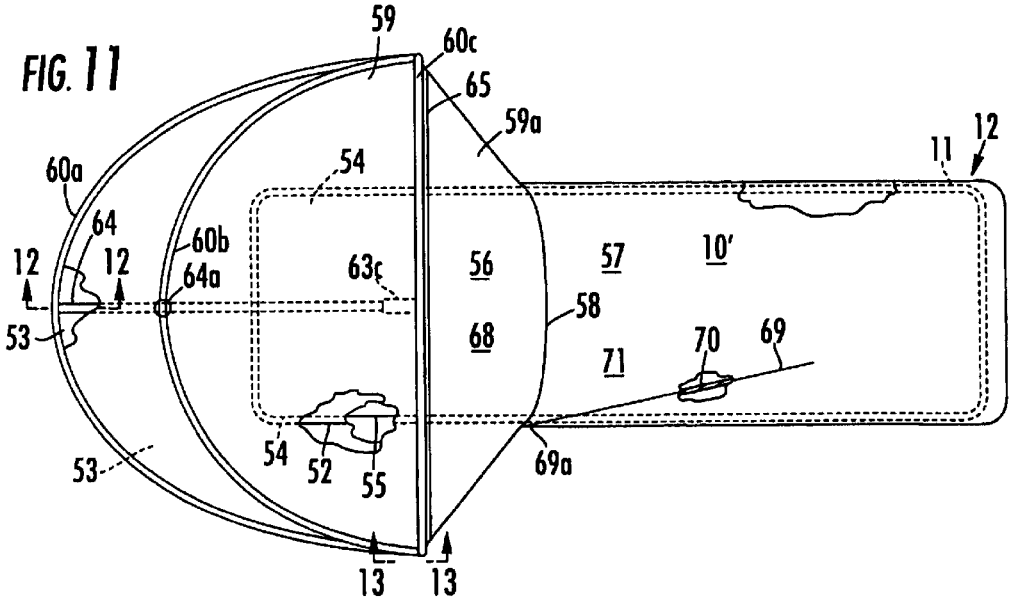
FIG. 11 is a top view of the embodiment shown in FIG. 10, but showing the brace wand installed inside the canopy.
Figure 12:
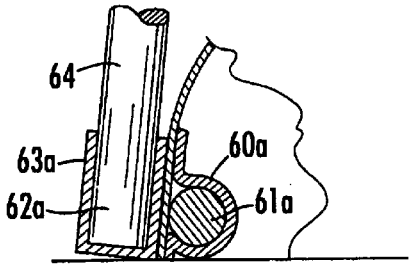
FIG. 12 is an enlarged, sectional view taken on Line 12—12 of FIG. 11.
Figure 13:
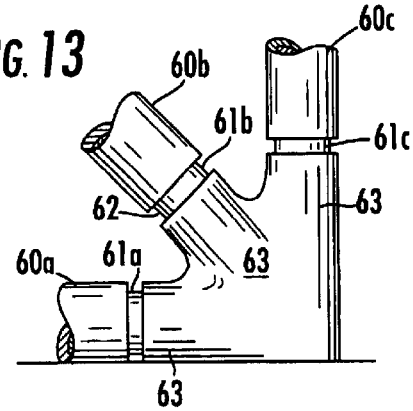
FIG. 13 is an enlarged, detail view taken on Line 13—13 of FIG. 11.

A third embodiment of the invention is shown in FIGS. 10–13. The rectangular, plastic-foam sleeping pad 11 (as described above) is bonded, at its bottom edges 52, to the floor 53 of the shelter (FIG. 11). The shelter floor 53 has a large, rectangular opening 54 slightly smaller than the pad 11, so that its edges overlap the edges of the pad by about one inch on all four sides—the overlap 55 being bonded to the bottom of the pad 11. The shelter is divided into a canopy section 56 and a foot-end section 57 by a juncture 58 (although the pad 11 is continuous between the sections). The foot-end section 57 has an outer shell 10', as described above that is preferably made of water-proof but air-and-vapor-breathable material; and the canopy section 56 is preferably made of waterproof nylon fabric, or other waterproof material, also as described above. Similarly, the foot-end section 57 of the shelter is of a tubular configuration. However, since it is joined to the canopy section 56, it is not closeable about the user's face, as is the tubular structure 12.

The canopy section 56 is also similar to that described above. The sheet 59 of material forming the canopy is equipped with three sleeves: a head-end sleeve 60*a*, an intermediate sleeve 60*b*, and an upright sleeve 60*c*. These sleeves are preferably fastened to the outside of the canopy material 59, transversely to the major axis of the shelter. Three resilient wands, the head-end wand 61*a*, the intermediate wand 61*b*, and the upright wand 61*c* (FIG. 13) are installed in their respective sleeves 60*a*–60*c* when the canopy is deployed. This is accomplished by inserting the ends 62 of the wands into pockets 63, sewn or otherwise fastened to the outside of the canopy section 56 on each side of the canopy approximately in line with the user's shoulders. Optionally, the sleeves 60*a*–60*c* and pockets 63 can be fastened to the inside of the canopy sheet 59. A brace wand 64, about half the length of the other three wands, has one end 62*a* inserted into a pocket 63*a* (FIG. 12) fastened on or adjacent the apex of the head-end sleeve 60*a* and the other end 62*c* inserted into a pocket 63*c* on or adjacent the apex of the upright sleeve 60*c*. Its purpose is to support the upright wand 61*c* in a vertical position. A hook-and-loop fastener strap 64*a*, fastened to or adjacent the apex of the intermediate sleeve 60*b* is wrapped around the brace wand 64 to hold it in the desired position relative to the canopy section.

The canopy material forms a curved panel 59*a* between the upright sleeve 60*c* and the juncture 58 of the foot-end section with the canopy section. It has a large opening 65 that extends from the juncture 58 nearly to the upright sleeve 60*c* and transversely from one side of the top of the sleeping pad 11 to the other. Two flexible panels (FIG. 10) are fastened together and to the shell 10' along the juncture line 58 and either of them can be used to close the opening 65. The inner panel 67 is insect-proof netting, and can be fastened to the canopy material along the two side edges and top edge of the opening 65 by a zipper 66. The outer panel 68 is made of the same material as the rest of the canopy material 59. A long separation 69 in the flexible shell 10' of the foot-end section 57 extends from about the position of the user's knees to one lower corner 69*a* of the panels 67 and 68 (the point at which these panels intersect the juncture line 58). This separation 69 is continuous with the separations at the corresponding sides of the panels 67 and 68. A zipper 70 is fastened to the sides of the separation 69 and continues around the side and top edges of the outer panel 68, so that, when the inner panel 67 is unzipped, the shell material and the inner and outer panels can be opened or closed as a single, flexible panel that can be folded over to one side of the shelter for easy entry into the shelter by the user. If the shelter is completely closed and the user desires to open the outer panel but have the inner panel closed, he can, from the inside of the shelter, unzip the inner panel, then unzip the outer panel, and then close the inner panel. If he wishes to close the outer panel, he can unzip the inner panel and close the outer panel. If he wishes to open the entire canopy, he can completely open both zippers 66 and 70 (or the zipper 70 can be opened as far as the juncture 58), remove the brace wand 64 and fold the entire canopy on top of the head wand 61*c*.

As in the previously-described embodiment of the invention, this shelter can be anchored to the ground by tent pegs driven through grommets (neither of which are shown) attached to the shelter.

This embodiment of the invention is also typically carried and stored in a coiled configuration in the conventional manner. Hence, it is simply unrolled, the three wands 61*a*–61*c* are installed, and the shelter is ready to be occupied. The brace wand 64 is necessary for supporting the upright wand 61*c* only when both panels 67 and 68 are open. Ordinarily, it can be supported by the fabric of the shell 10' and the canopy material 59.

Figure 14:
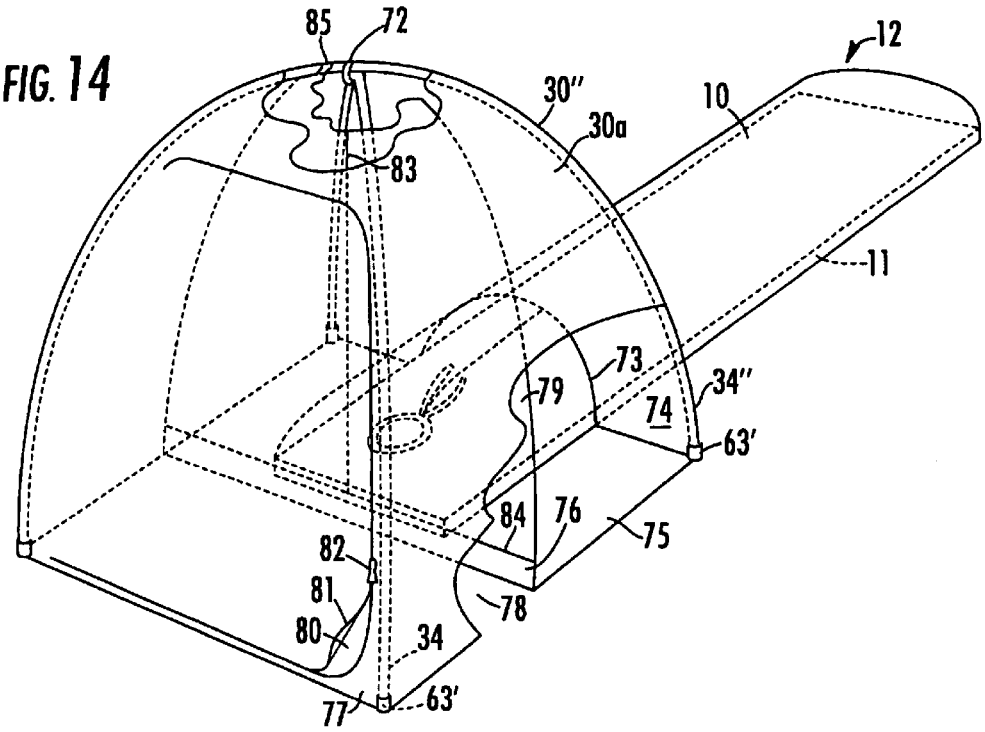
FIG. 14 is a perspective view of a fourth embodiment of the invention with some parts broken away to show internal features.

A fourth embodiment of the invention is shown in FIG. 14. A canopy 30", having a rectangular base, is formed of canopy material 30*a*, as described above, stretched over two long, flexible wands 34" fastened together at their apexes, and to the inside of the top of the canopy 30 by a hook-and-loop strap 72 fastened thereto. The ends of the wands 34" are seated in pockets 63' fastened into the bottom corners of the canopy 30". The head-end portion of the bivouac bag 12 (which is the same as shown in FIG. 1) extends through an opening 73 in the side 74 of the canopy 30" toward the user's feet, and the shell 10' of the bivouac bag 12 is joined to the opening 73 with a watertight seal. A floor 75 of the canopy material 30*a* surrounds, and is fastened to, the head-end portion of the sleeping pad by one of the methods previously described. However, the floor 75 in this embodiment covers only a portion of the rectangular base of the canopy 30". Adjacent the head end of the bivouac bag 12, the floor 75 is bent upwardly to provide a dam 76 between the bivouac bag and the side 77 of the canopy opposite the bivouac bag, the ends of the dam 76 being fastened to the sides of the canopy with a watertight seal. This forms a vestibule 78 between the bivouac bag and the side 77 of the canopy that is open to the ground and affords a place in which wet garments, etc. can be stored. The dam 76 prevents ground water from entering the sleeping portion of the canopy 30".

A substantially-vertical panel 79 of insect-proof netting is fastened to the top of the dam 76 and to the inside of the canopy to complete a barrier between the vestibule 78 and the sleeping portion of the canopy 30". A large opening 80 in the side 77 of the canopy opposite the bivouac bag 12 is closeable by a panel 81, integral on one side thereof with the canopy material and equipped on its other three sides with a zipper 82 that is also attached to the three open sides of the panel 81. This opening 80 provides entry into the vestibule 78. Similarly, a substantially-vertical separation in the insect-netting panel 79 is provided with a zipper 83. This is joined by a horizontal separation between the insect netting 79 and the dam 76 in which a zipper 84 is installed. These zippers 83 and 84 provide entry into the sleeping portion of the canopy 30".

To use this embodiment of the shelter, the user needs only to enter the shelter through the opening 80 and install the wands from inside the shelter. Since the corners of the canopy 30" provide two-sided support for each wand, the long sleeves described in the previous embodiments of the invention are not necessary for holding the wands in a desired position relative to the canopy. Two small holes 85 in the top portion of the insect netting 79 are provided for passage therethrough of the wands (only one hole is shown).

A portable, personal bivouac shelter has been described that eliminates part of the bulk and weight of conventional camping gear, and provides a shelter with a canopy that can be easily set up, and completely opened, completely closed, or partially opened. Although the invention has been described in considerable detail, it should be noted that many details can be varied without departing from the spirit and scope of the invention, as defined in the following claims.

The invention claimed is:

1. A portable, bivouac shelter comprising:

a resilient sleeping pad;

a thin, flexible, waterproof shell having edges attached to those of the sleeping pad to form a tubular structure wherein the sleeping pad comprises the bottom wall thereof, wherein the edges of the flexible shell are attached to those of the sleeping pad by bonding them together with a bonding agent, said structure being closed at both ends except for an opening defined near one end of the shell for access by a user's face, and also defining a separation in the shell extending from the opening toward the foot end of the shelter for a distance sufficient to provide easy entry of a user into the tubular structure, and;

means for closing the separation to the desired extent.

2. The shelter of claim 1 wherein the means for closing the separation comprises a zipper attached to the edges of the separation and coextensive therewith.

3. The shelter of claim 1 further including means for adjusting the size of the opening.

4. The shelter of claim 3 wherein the means for adjusting the size of the opening comprises a sleeve forming the edges of said opening, and a drawstring in the sleeve, the ends of which extend beyond those of the sleeve, whereby the sleeve can be compressed on the drawstring to the extent desired, and the ends of the drawstring can be tied together to secure the sleeve at the desired size for said opening.

5. The shelter of claim 1 wherein the shell is air-and-vapor-breathable, to avoid condensation of water vapor inside the shelter.

6. A portable, bivouac shelter comprising:

a resilient sleeping pad;

a thin, flexible, waterproof shell having edges attached to those of the sleeping pad to form a tubular structure wherein the sleeping pad comprises the bottom wall thereof, wherein a longitudinal slit is defined in the edges of the sleeping pad and the edges of the flexible shell are inserted into said slit to form a top layer and a bottom layer of the flexible shell material on the edge portions of the sleeping pad above the slit, and wherein said top and bottom layers are stitched together through said edge portions of the sleeping pad, and further including adhesive material in the slit below said bottom layer of the flexible shell, said structure being closed at both ends except for an opening defined near one end of the shell for access by a user's face, and also defining a separation in the shell extending from the opening toward the foot end of the shelter for a distance sufficient to provide easy entry of a user into the tubular structure, and; means for closing the separation to the desired extent.

7. The shelter of claim 6 wherein the means for closing the separation comprises a zipper attached to the edges of the separation and coextensive therewith.

8. The shelter of claim 6 further including means for adjusting the size of the opening.

9. The shelter of claim 8 wherein the means for adjusting the size of the opening comprises a sleeve forming the edges of said opening, and a drawstring in the sleeve, the ends of which extend beyond those of the sleeve, whereby the sleeve can be compressed on the drawstring to the extent desired, and the ends of the drawstring can be tied together to secure the sleeve at the desired size for said opening.

10. The shelter of claim 6 wherein the shell is air-and-vapor-breathable, to avoid condensation of water vapor inside the shelter.

* * * * *